US009132566B2

(12) United States Patent
Chiang

(10) Patent No.: US 9,132,566 B2
(45) Date of Patent: Sep. 15, 2015

(54) AUTOMATED BOOK PUNCH

(71) Applicant: Chung Sheen Technology Co., Ltd., Taichung (TW)

(72) Inventor: Chou-Chih Chiang, Taichung (TW)

(73) Assignee: CHUNG SHEEN TECHNOLOGY CO., LTD., Taichung (TW)

( * ) Notice: Subject to any disclaimer, the term of this patent is extended or adjusted under 35 U.S.C. 154(b) by 203 days.

(21) Appl. No.: 13/829,122

(22) Filed: Mar. 14, 2013

(65) Prior Publication Data

US 2014/0260856 A1 Sep. 18, 2014

(51) Int. Cl.

| | |
|---|---|
| ***B26D 7/32*** | (2006.01) |
| ***B42C 5/00*** | (2006.01) |
| ***B26F 1/02*** | (2006.01) |
| *B26D 5/16* | (2006.01) |
| *B26D 5/30* | (2006.01) |
| *B26D 7/01* | (2006.01) |
| *B26D 7/06* | (2006.01) |
| *B26D 7/00* | (2006.01) |

(52) U.S. Cl.

CPC ... *B26D 7/32* (2013.01); *B26F 1/02* (2013.01); *B42C 5/00* (2013.01); *B26D 5/16* (2013.01); *B26D 5/30* (2013.01); *B26D 7/015* (2013.01); *B26D 7/0675* (2012.01); *B26D 2007/0018* (2013.01); *Y10T 83/2192* (2015.04)

(58) Field of Classification Search

CPC ..... Y10T 83/6476; Y10T 83/0476; Y10T 83/0495; Y10T 83/0505; Y10T 83/051; Y10T 83/2192; Y10T 83/6484; Y10T 83/6494; Y10T 83/6496; Y10T 83/6499; Y10T 83/65; Y10T 83/6502; Y10T 83/8727; Y10T 83/9411; Y10T 83/942; Y10T 83/9423; Y10T 83/904; Y10T 83/2194; B65H 3/24; B65H 9/00; B65H 15/00; B42C 5/00; B26F 2210/00; B26F 2210/02; B26F 1/02; B26D 5/00; B26D 5/16; B26D 5/08; B26D 2007/0018; B26D 7/01; B26D 7/0608; B26D 7/32; B26D 7/015; B26D 7/0675

USPC ..... 83/29, 33, 35, 36, 155, 401, 405, 406, 83/704, 705, 707, 708, 709, 549, 679, 682, 83/684, 904

See application file for complete search history.

(56) References Cited

U.S. PATENT DOCUMENTS

| | | | | |
|---|---|---|---|---|
| 3,739,672 | A * | 6/1973 | Pfaffle | 83/256 |
| 5,778,749 | A * | 7/1998 | Dunn | 83/549 |
| 6,796,209 | B2 * | 9/2004 | Boss | 83/365 |
| 7,255,032 | B2 * | 8/2007 | Ho | 83/573 |
| 7,404,246 | B2 * | 7/2008 | Chiang | 29/525.01 |
| 2007/0240552 | A1 * | 10/2007 | Chiang | 83/684 |

* cited by examiner

*Primary Examiner* — Phong Nguyen
(74) *Attorney, Agent, or Firm* — Chun-Ming Shih

(57) ABSTRACT

An automated book punch includes a base, a positioning mechanism, a punching mechanism, a conveying mechanism, a transfer mechanism and a paper straightening/collection mechanism: the base has a paper tray; the positioning mechanism at a fixed position (an open position) locates a book held in the paper tray (allows the book to pass); the punching mechanism is used to punch a book held in the paper tray; the conveying mechanism conveys a book in the paper tray; the transfer mechanism is able to shift a punched book from the conveying mechanism to a predetermined position; the paper straightening/collection mechanism collects and straightens a book from the transfer mechanism.

2 Claims, 18 Drawing Sheets

AUTOMATED BOOK PUNCH

BACKGROUND OF THE INVENTION

1. Field of the Invention

The present invention relates to a punch, particularly an automated book punch.

2. Description of the Prior Art

An ordinary loose-leaf book composed of a plenty of papers whose margins have a number of punched holes arranged in a predetermined spacing is formed with a spiral coil threaded through the holes.

In general, the methods to punch a book are classified into full-manual punching and semi-automatic punching: the former depends on pure manual operation which requires obvious manpower/time and is unfavorable to mass production of loose-leaf books; the latter needs a worker to insert each book into a punch, remove, collect and stack the punched book and still fails to match demands of mass production despite less time/manpower spent than that of the full-manual punching.

SUMMARY OF THE INVENTION

The object of the present invention is to provide an automated book punch which is able to save time and manpower effectively.

The other object of the present invention is to provide an automated book punch which is applicable to punching a plenty of books.

The automated book punch achieving the above purposes comprises: a base with a paper tray; a positioning mechanism held in the base for reciprocal movement from a fixed position at which the positioning mechanism locates each book in the paper tray to an open position at which the positioning mechanism allows the book in the paper tray to pass; a punching mechanism held in the base and used to punch each book in the paper tray; a conveying mechanism installed in the base and conveying each book held in the paper tray; a transfer mechanism installed in the base and used to transfer each punched book to a predetermined position from the conveying mechanism; a paper straightening/collection mechanism which is used to collect and straighten all books from the transfer mechanism.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
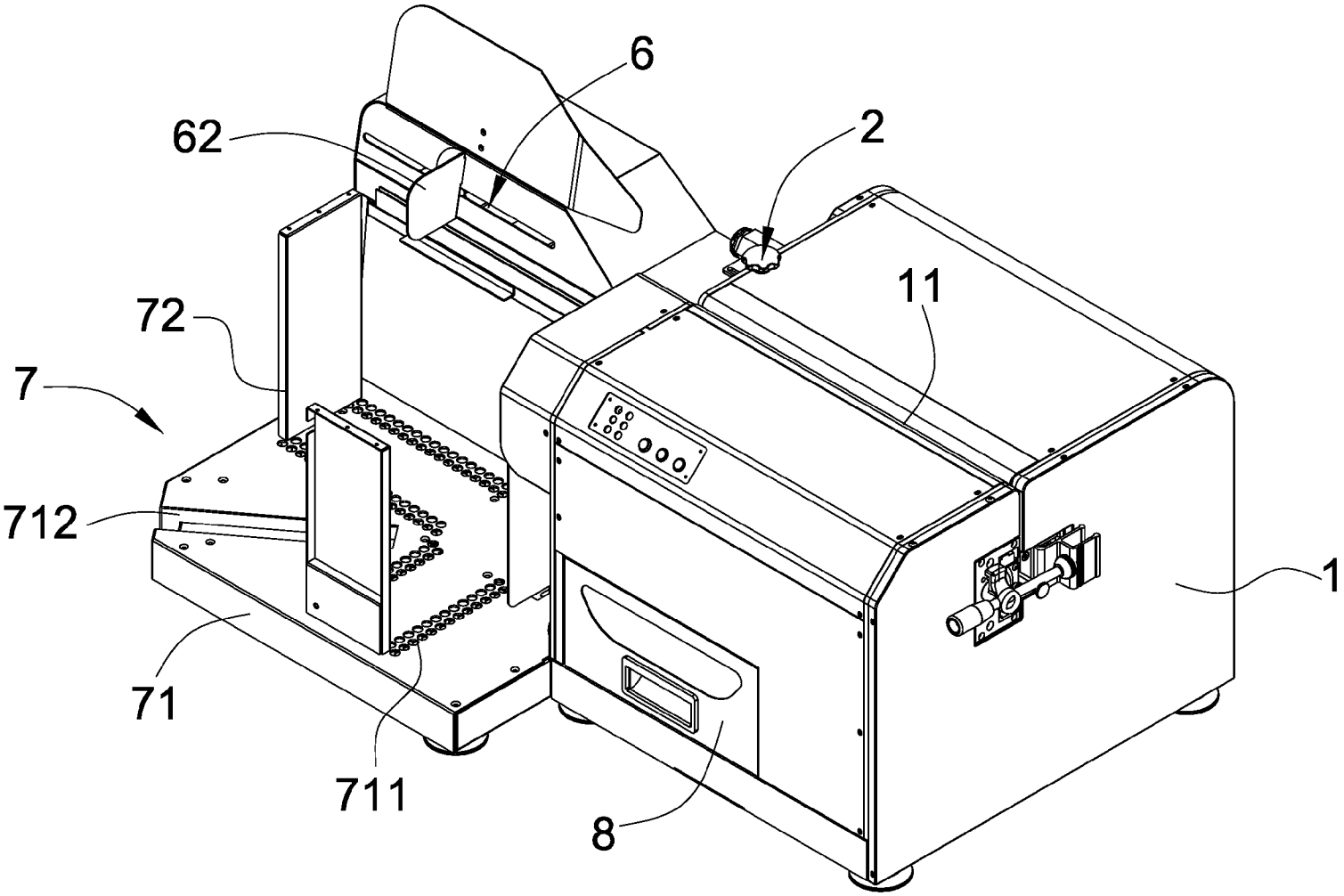
FIGS. 1 and 2 are schematic perspective views illustrating the present invention of an automated book punch.
Figure 2:
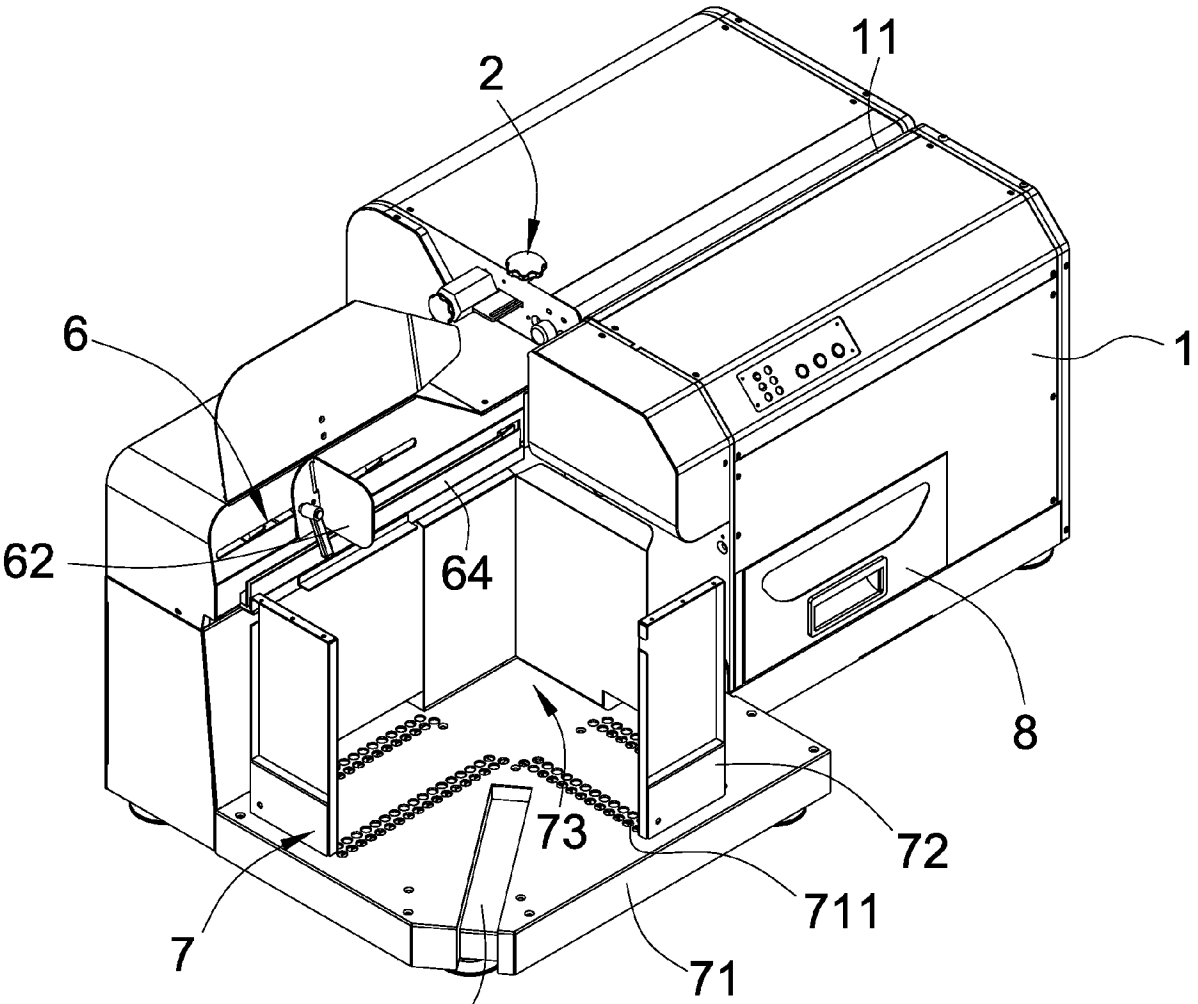

Referring to FIGS. 1 and 2 which illustrate the present invention of an automated book punch comprising a base 1, a positioning mechanism 2, a sensor 3, a punching mechanism 4, a conveying mechanism 5, a transfer mechanism 6, a paper straightening/collection mechanism 7 and a debris collection box 8:

The base 1 which is firmly situated on a plane (e.g., ground level) is provided with a paper tray 11.

Figure 3:
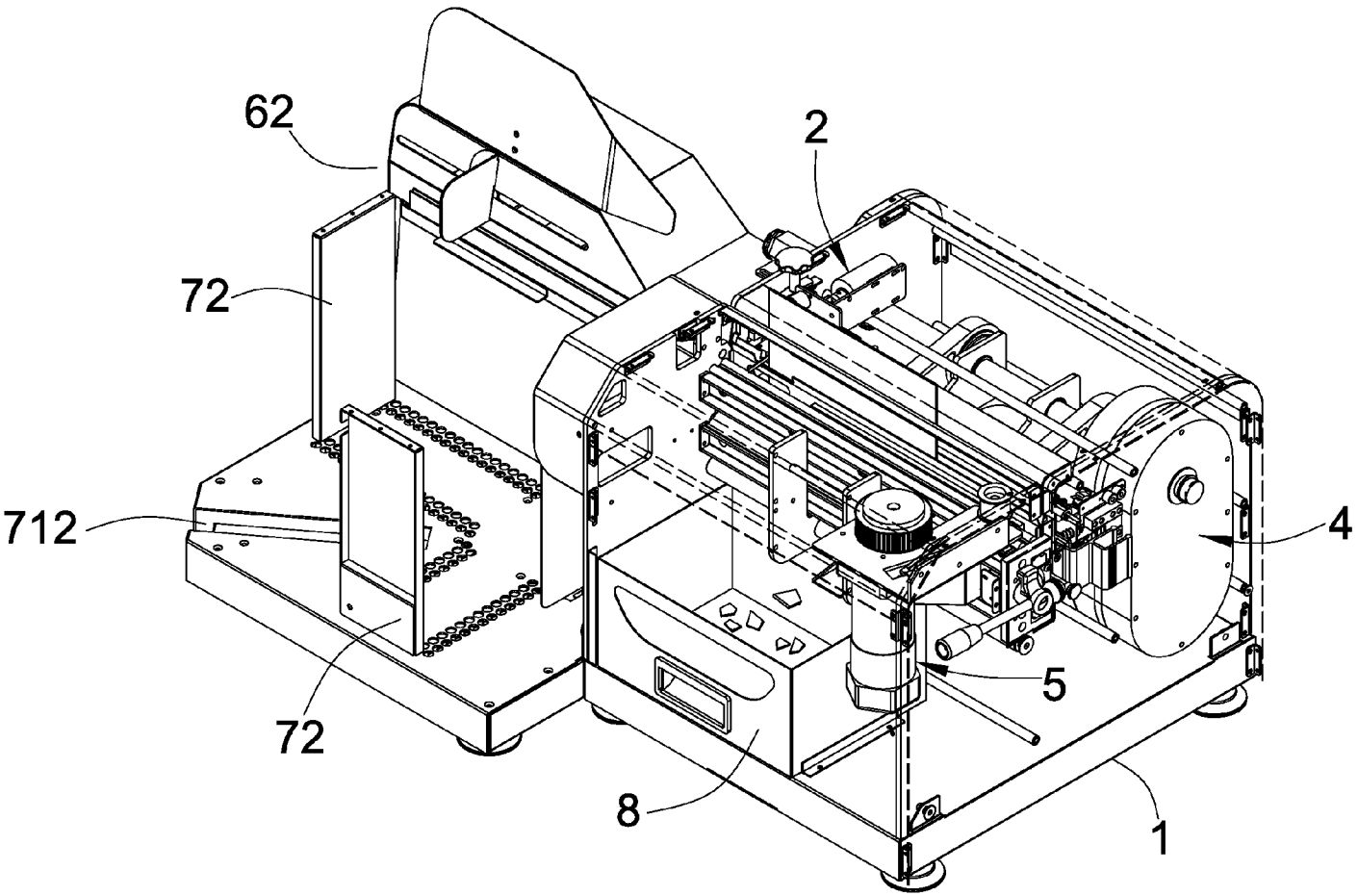
FIG. 3 is a schematic perspective view illustrating partial components in the present invention.
Figure 4:
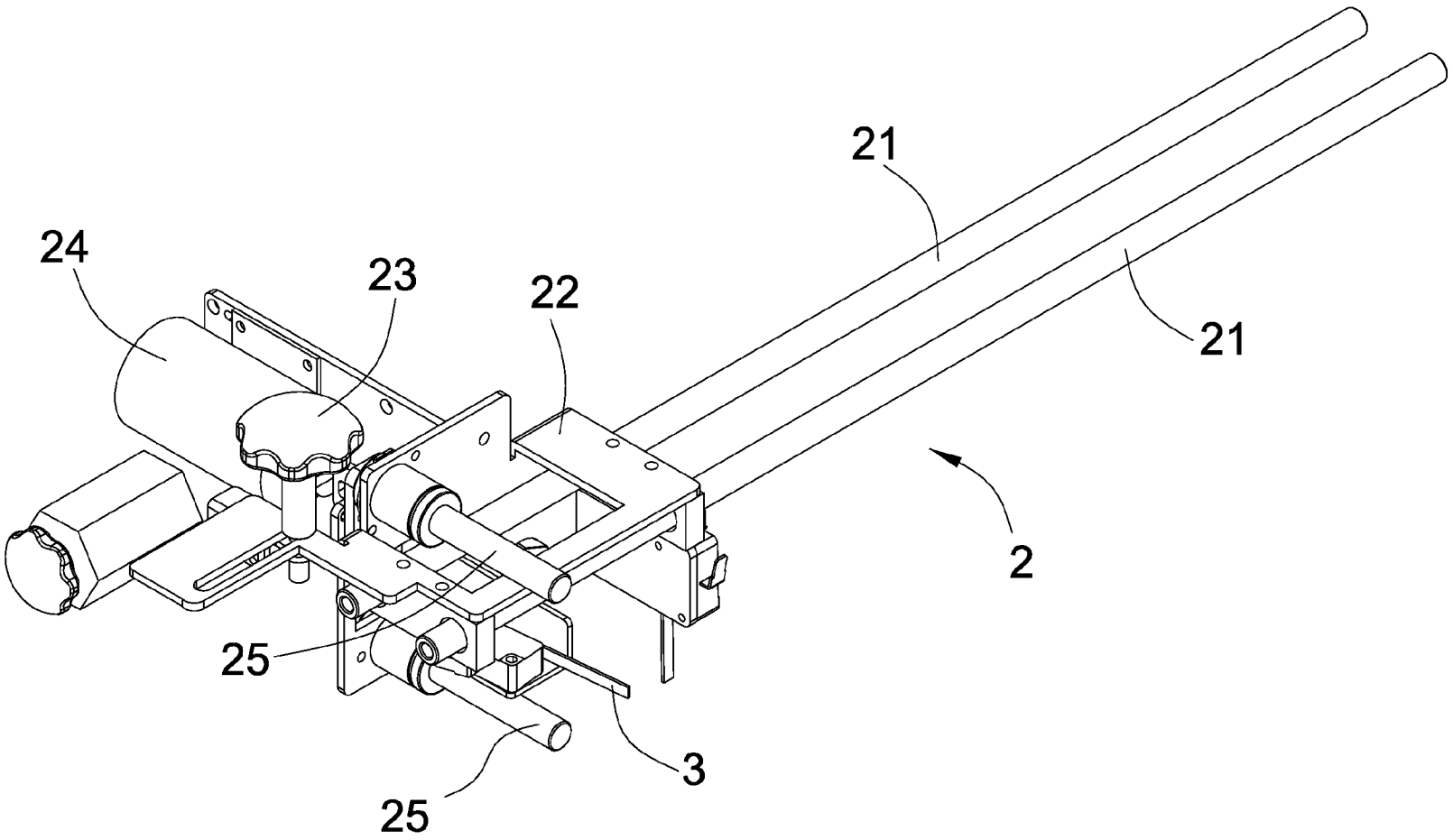
FIG. 4 is a schematic perspective view of a positioning mechanism.

Referring to FIGS. 3 and 4 which illustrate the positioning mechanism 2 situated at an exit of the paper tray 11 on the base 1 is used in positioning a book 99 to be punched. The positioning mechanism 2 comprises two slide bars 21, a slide carriage 22, a knob 23, a positioning motor 24, two locators 25 and a sensor 3: the slide bars 21 are horizontally held in the base 1; the slide carriage 22 is movably connected to the slide bars 21 and linearly and reciprocally shifted along the slide bars 21 under effect of an external force; the knob 23 locked on the slide carriage 22 can be screwed (or unscrewed) so that the slide carriage 22 is incapable of (capable of) completing relative sliding along the slide bars 21 under effect of an external force; the positioning motor 24 is situated on the slide carriage 22; the two locators 25, which are parallel to each other and link and are driven by the positioning motor 24, complete reciprocal movement between a fixed position and an open one; the sensor 3 installed on the slide carriage 22 of the positioning mechanism 2. In the present invention, the slide carriage 22 on the positioning mechanism 2 can be flexibly positioned according to dimensions of the book 99 to be punched: (a) unscrew the knob 23; (b) move the slide carriage 22 along the slide bars 21 until a proper position; (c) screw the knob 23 to correctly position the slide carriage 22.

Figure 5:
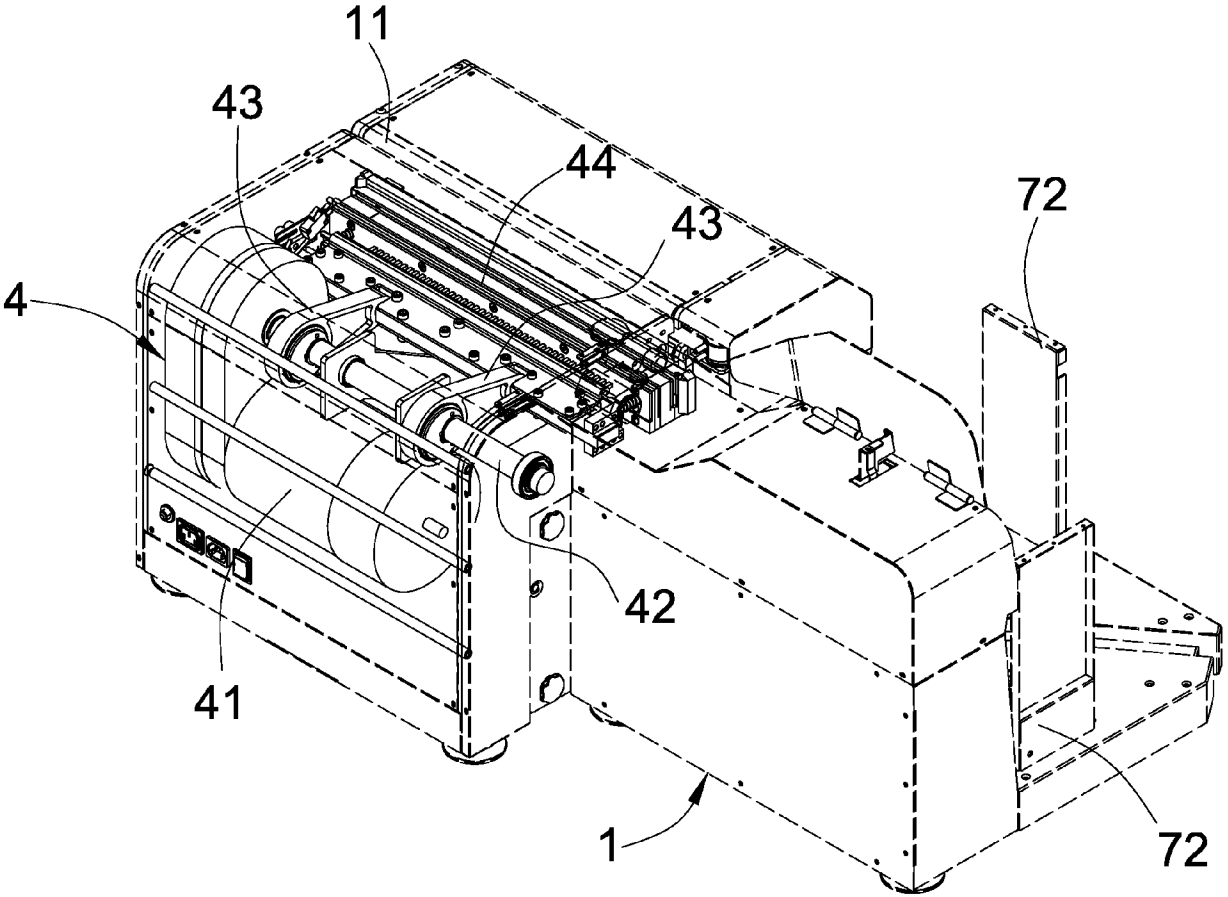
FIG. 5 is a perspective view of a punching mechanism installed on a base.
Figure 6:
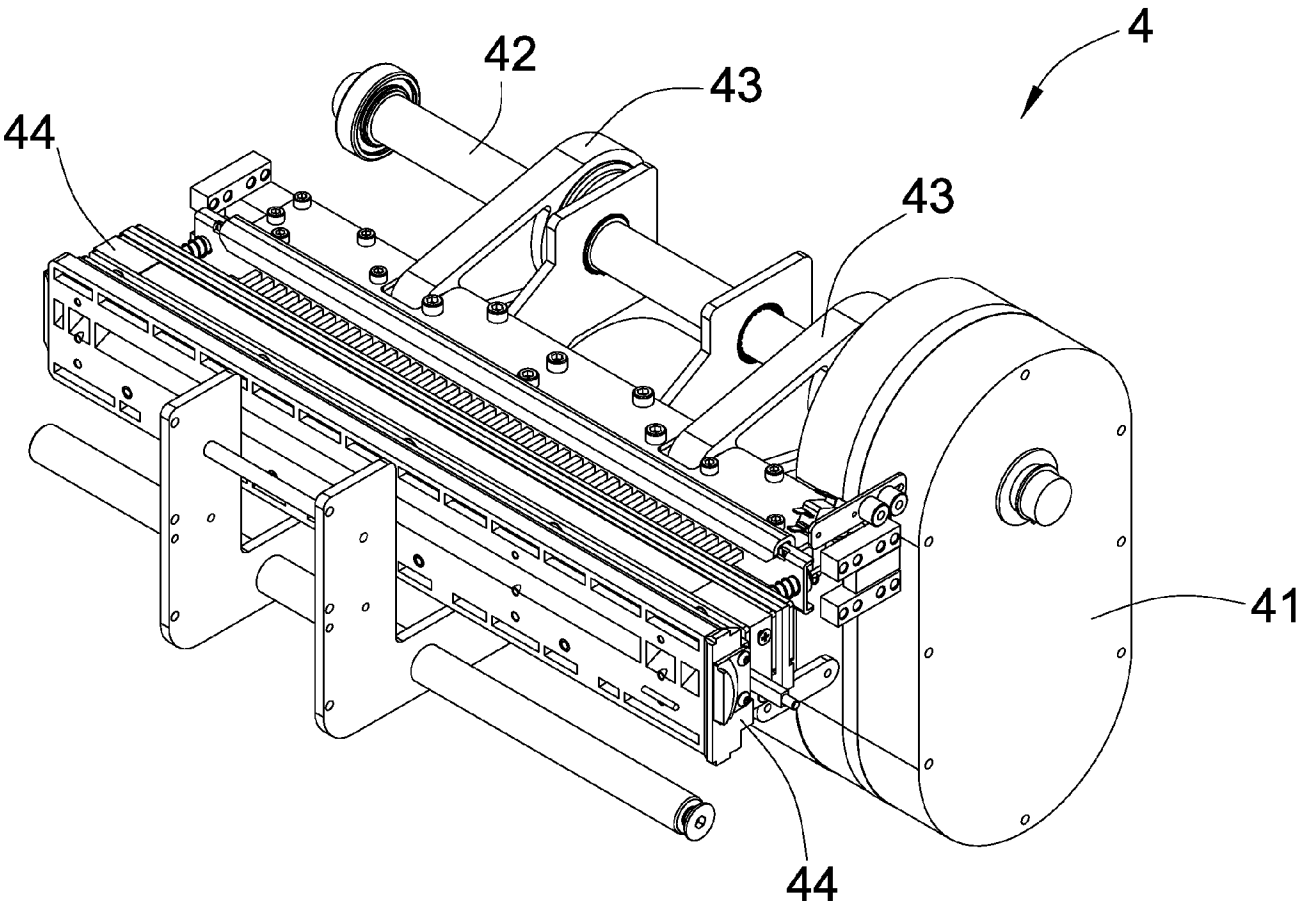
FIG. 6 is a schematic perspective view of a punching mechanism.

Referring to FIGS. 5 and 6 which illustrate the punching mechanism 4 installed behind the paper tray 11 on the base 1 is used to punch the book 99 held in the paper tray 11 on the base 1. The punching mechanism 4 comprises a punch motor 41, an output shaft 42, a plurality of cams 43 and a punching tool 44: the punch motor 41 is held in the base 1; the output shaft 42 which links and is driven by the punch motor 41 turns locally; the cams 43 are coupled with the output shaft 42; the punching tool 44 links and coordinates the cams 43 to punch the book 99 when the output shaft 42 is driven to rotate by the punch motor 41.

Figure 7:
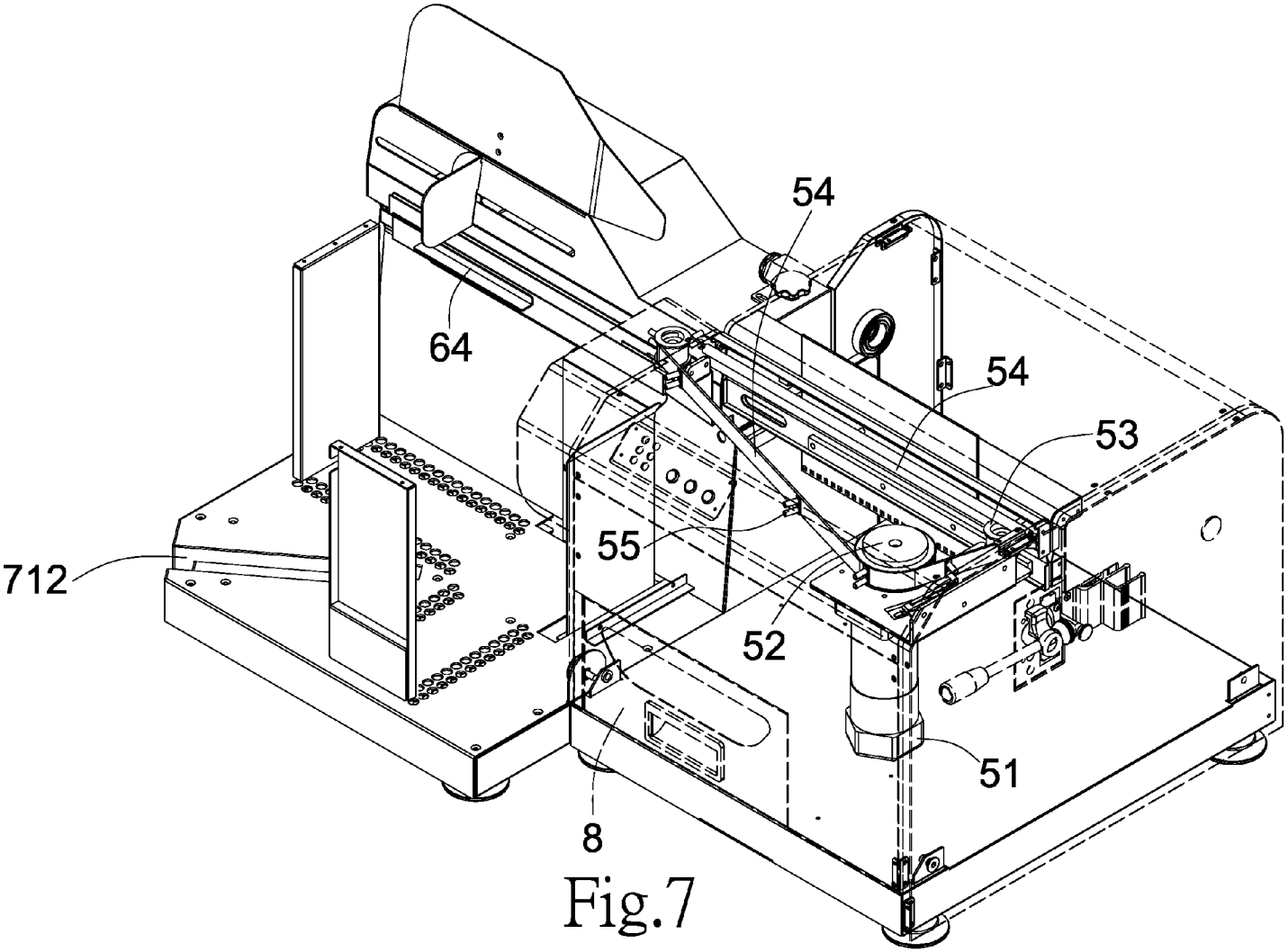
FIG. 7 is a perspective view of a conveying mechanism installed on a base.
Figure 8:
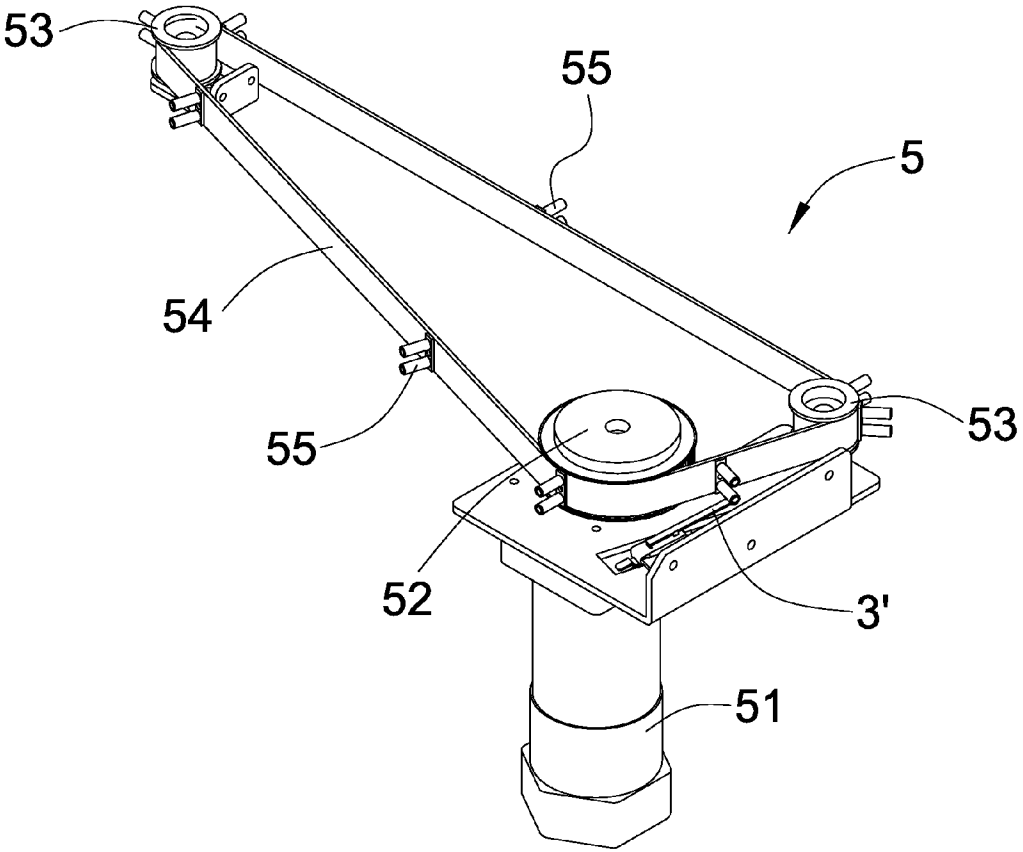
FIG. 8 is a schematic perspective view of a conveying mechanism.

Referring to FIGS. 7 and 8 which illustrate the conveying mechanism 5 installed in front of the paper tray 11 on the base 1 is used to convey the book 99 held in the paper tray 11. The conveying mechanism 5 comprises a conveying motor 51, a master wheel 52, a slave wheel 53 and a belt 54: the conveying motor 51 is securely held in the base 1; the master wheel 52 which links and is driven by the conveying motor 51 turns locally; the slave wheel 53 is properly pivoted to the base 1 and turns locally; the belt 54 encircling both the master wheel 52 and the slave wheel 53 is driven to turn by the master wheel 52 and comprises a number of conveying columns 55 situated on an external surface and arranged in a predetermined spacing.

Figure 9:
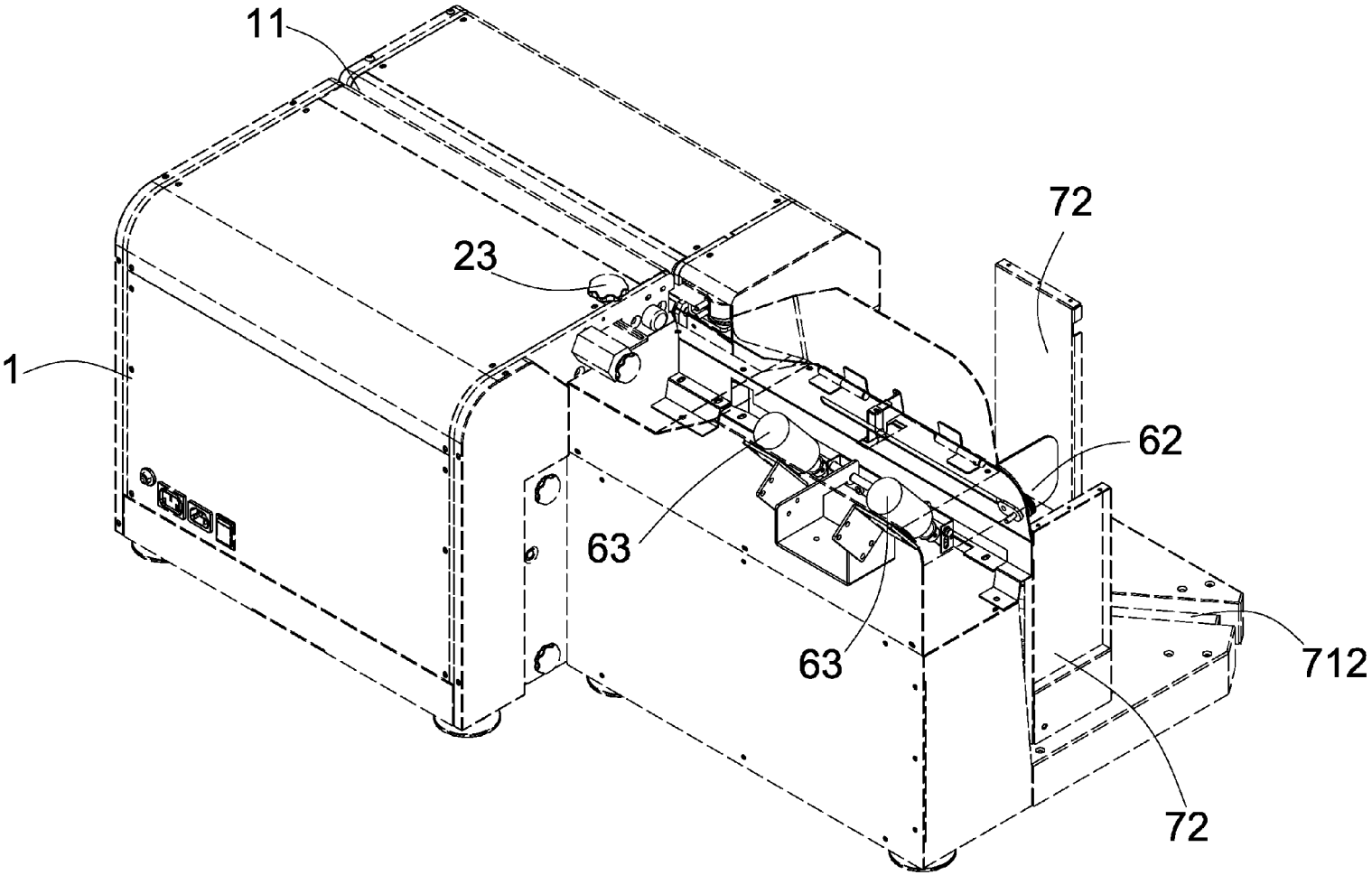
FIG. 9 is a perspective view of a transfer mechanism installed on a base.
Figure 10:
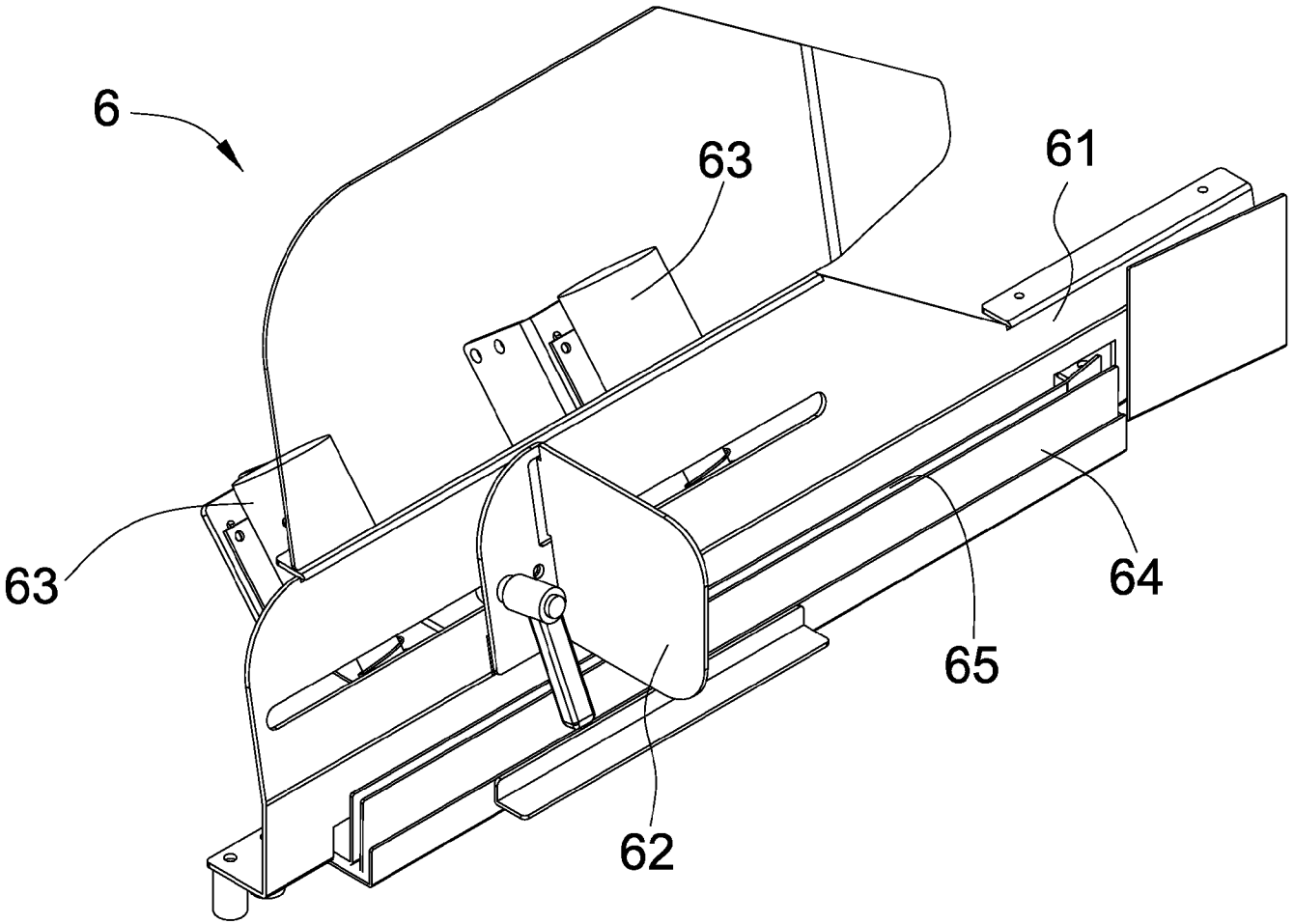
FIG. 10 is a schematic perspective view of a transfer mechanism.

Referring to FIGS. 9 and 10 which illustrate the transfer mechanism 6 installed at left back of the base 1 is used to transfer the punched book 99 to a predetermined gathering position from the conveying mechanism 5. The transfer mechanism 6 comprises a backup plate 61, a baffle 62, two transfer motors 63 and a pivot plate 64: the backup plate 61 is installed on the base 1; the baffle 62 situated on the backup plate 61 moveably slides along the backup plate 61; the transfer motors 63 are installed on the backup plate 61; the pivot plate 64 linking and driven by the transfer motors 63 is able to complete reciprocal movement between an upper position and a lower one and comprises a transfer slot 65 which accesses the paper tray 11 on the base 1 when the pivot plate 64 is moved to the upper position. In the present invention, the baffle 62 on the transfer mechanism 6 is flexibly positioned according to dimensions of the book 99 to be punched.

Figure 11:
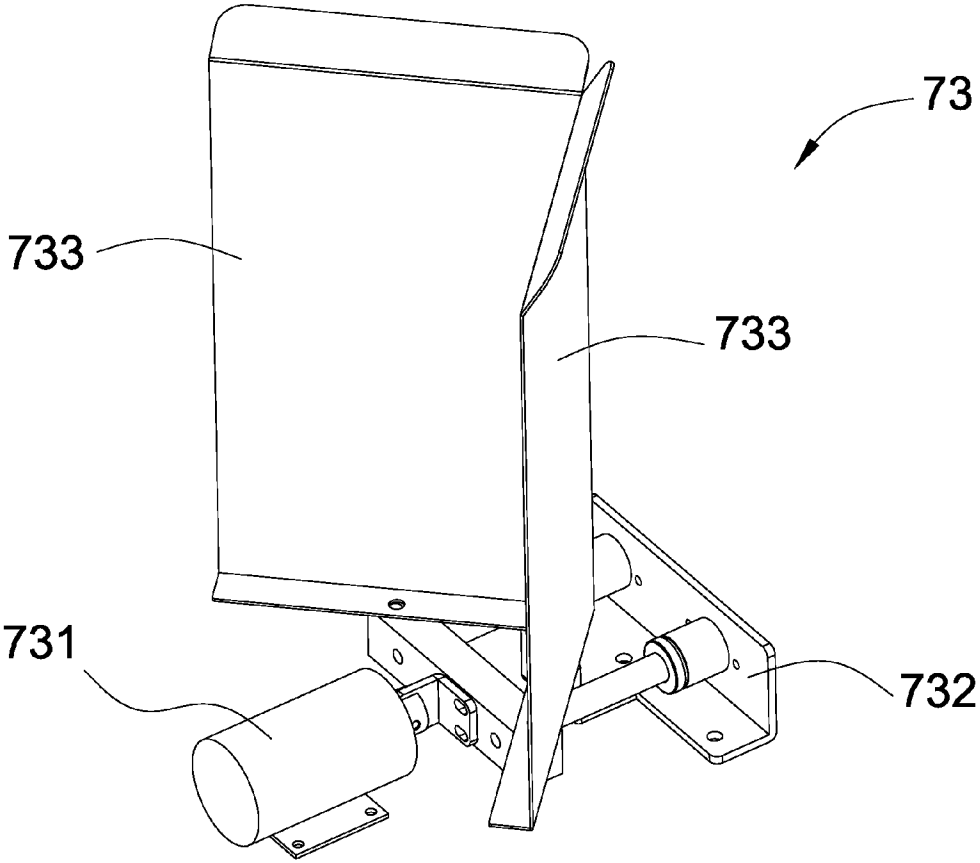
FIG. 11 is a schematic perspective view of a paper straightening/collection mechanism.

Referring to FIGS. 1, 2 and 11 which illustrate the paper straightening/collection mechanism 7 is used to receive and straighten the book 99 conveyed from the transfer mechanism 6. The paper straightening/collection mechanism 7 comprises a collection platform 71, a plurality of limited posts 72 and a paper straightening device 73: the collection platform 71 located at one side of the base 1 and under the transfer mechanism 6 comprises a number of spacing holes 711 arranged in a predetermined spacing as well as a book access slot 712; the limited posts 72 are flexibly plugged into the spacing holes 711 in accordance with dimensions of the book 99; the paper straightening device 73 situated at one corner of the collection platform 71 is used to push the book 99 on the collection platform and provided with a paper straightening motor 731, a paper straightening base 732 and a pair of push-off plates 733: the paper straightening motor 731 is installed on the collection platform 71; the paper straightening base 732 is synchronously actuated with the paper straightening motor 731; the pair of push-off plates 733 is situated on the paper straightening base 732.

Figure 17:
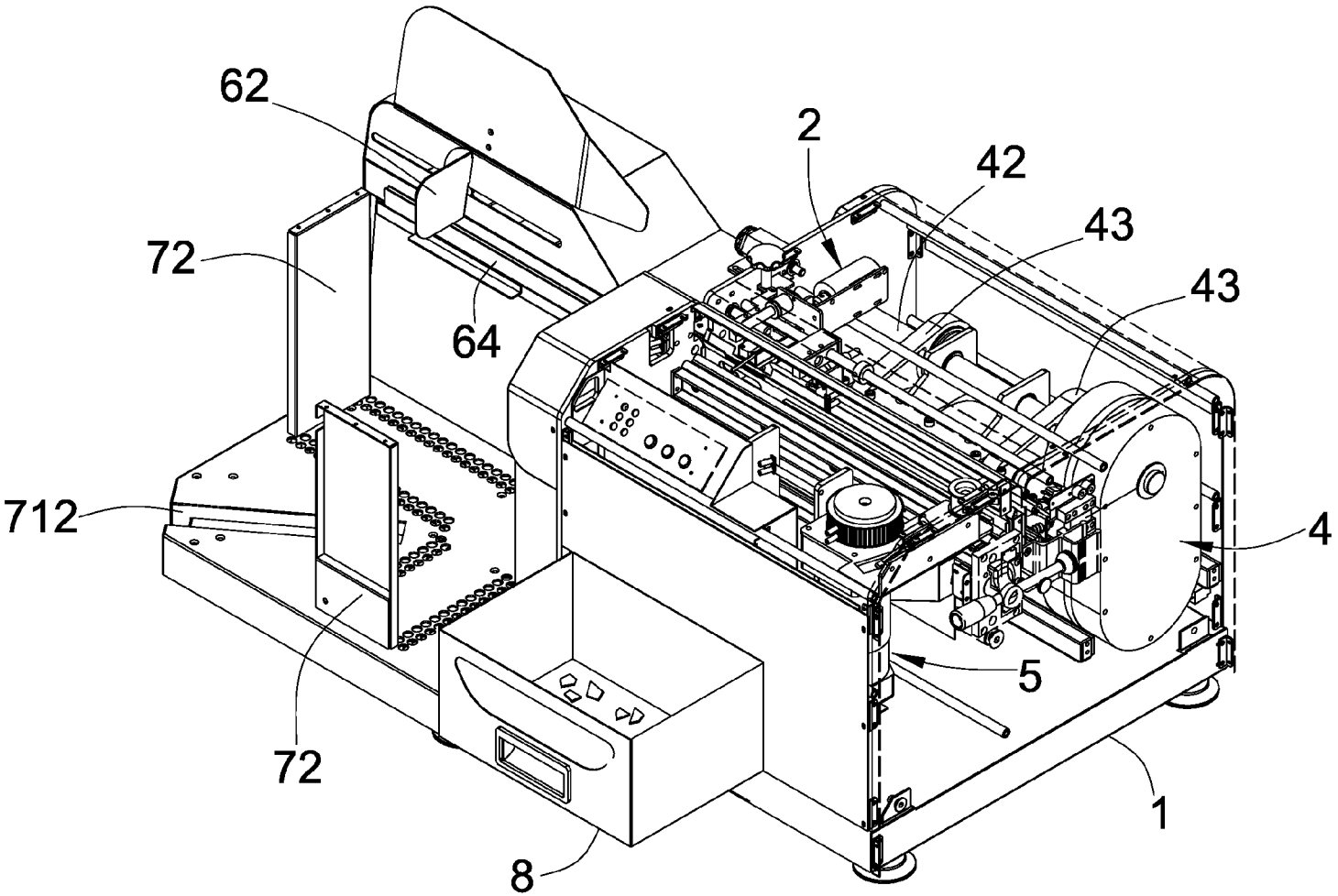
FIG. 17 is a schematic view which illustrates a debris collection box can be removed from a base.

Referring to FIG. 17 which illustrates the separable debris collection box 8 installed on the base 1 and under the paper tray 11 is used to collect remaining debris with the book 99 punched by the punching mechanism 4.

Figure 12:
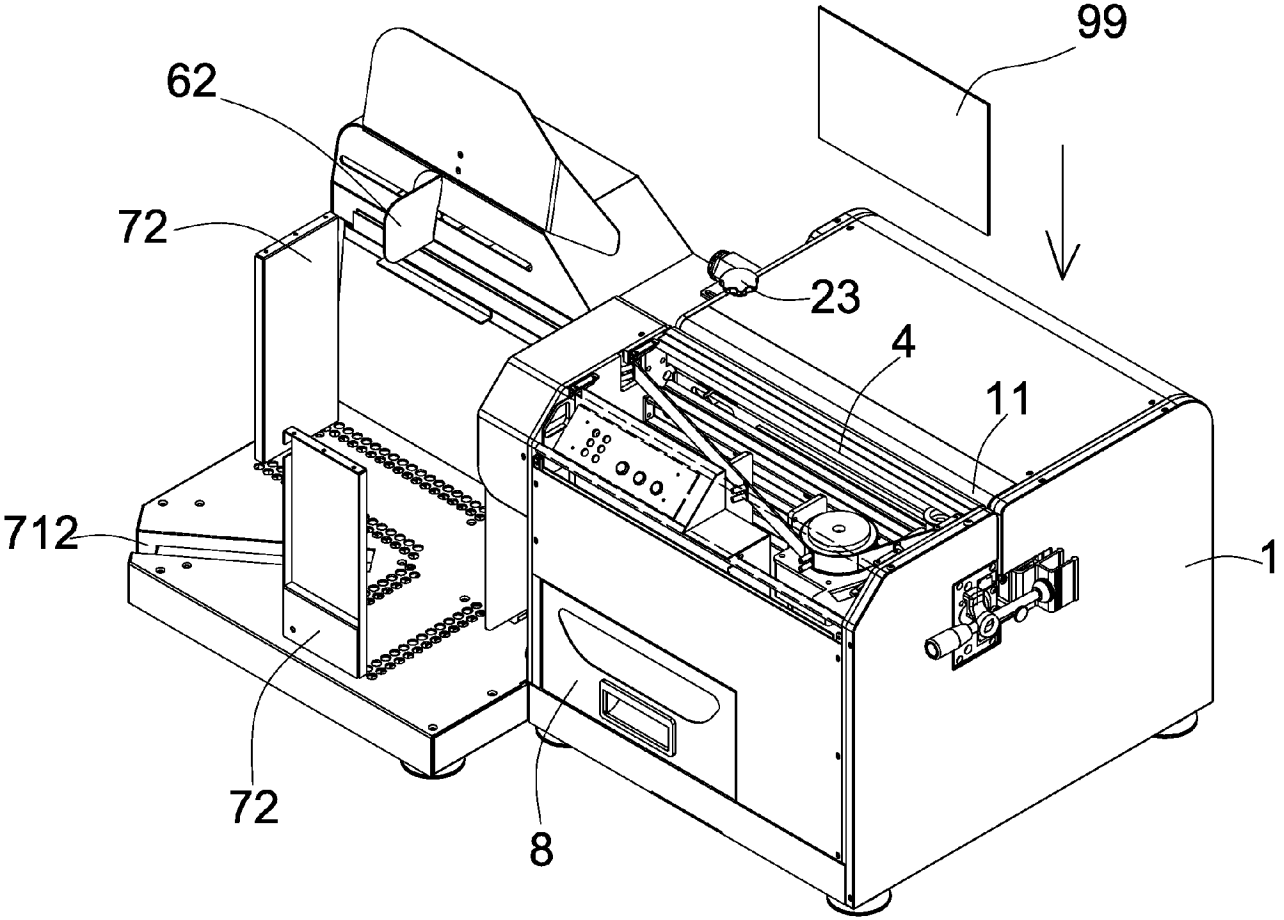
FIG. 12 is a schematic view which illustrates a book to be punched is held in a paper tray on a base.
Figure 13:
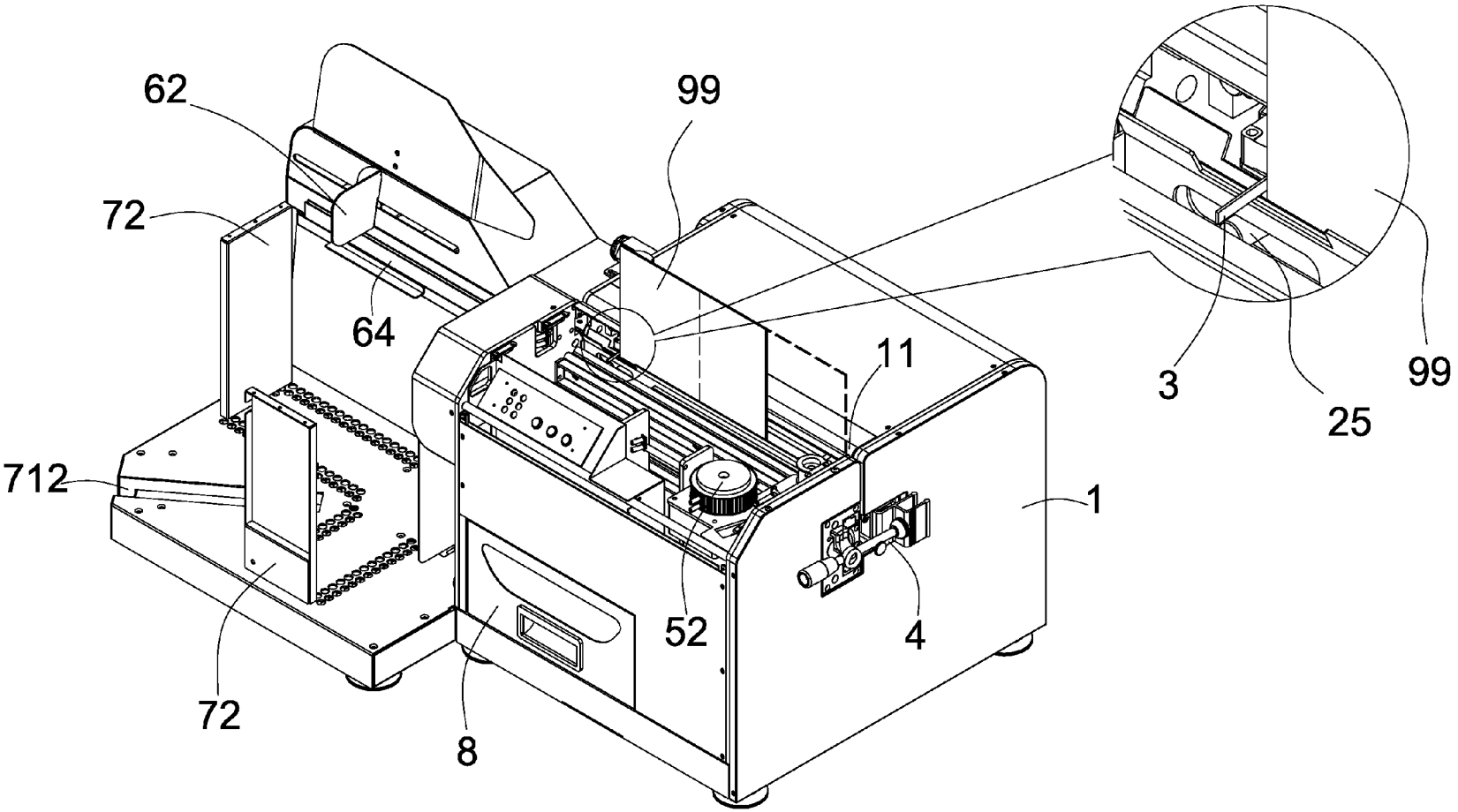
FIG. 13 is a schematic view which illustrates a book is moved and resists locators.

The above disclosure introduces a preferred embodiment of the present invention of an automated book punch, all components thereon and an assembling method thereof. The method to use the present invention is disclosed as follows:

As shown in FIG. 12, the book 99 to be punched by the present invention of an automated book punch should be held in the paper tray 11 on the base 1 and pushed to resist the locators 25 in the positioning mechanism 2 (FIG. 13 for the locators 25 which are situated at a predetermined position and extends in the paper tray 11). When the book 99 is detected by the sensor 3, the punch motor 41 of the punching mechanism 4 is actuated to initiate a punching process of the book 99 with the punching tool 44 driven by both the output shaft 42 and the cams 43. After a punching process completed with the punching tool 44, the locators 25 which are driven by the positioning motor 24 of the positioning mechanism 2 are moved to an open position from a fixed one, receding and staying beyond the paper tray 11. The book 99 is conveyed and transferred to the transfer slot 65 of the pivot plate 64 in the transfer mechanism 6 by the belt 54 and the conveying columns 55 thereon which encircle both the master wheel 52 and the slave wheel 53 under effect of the conveying motor 51 of the conveying mechanism 4. The function of the conveying motor 51 is interrupted when the conveying columns 55 contact the sensor 3' near the master wheel 52 (FIG. 8).

Figure 14A:
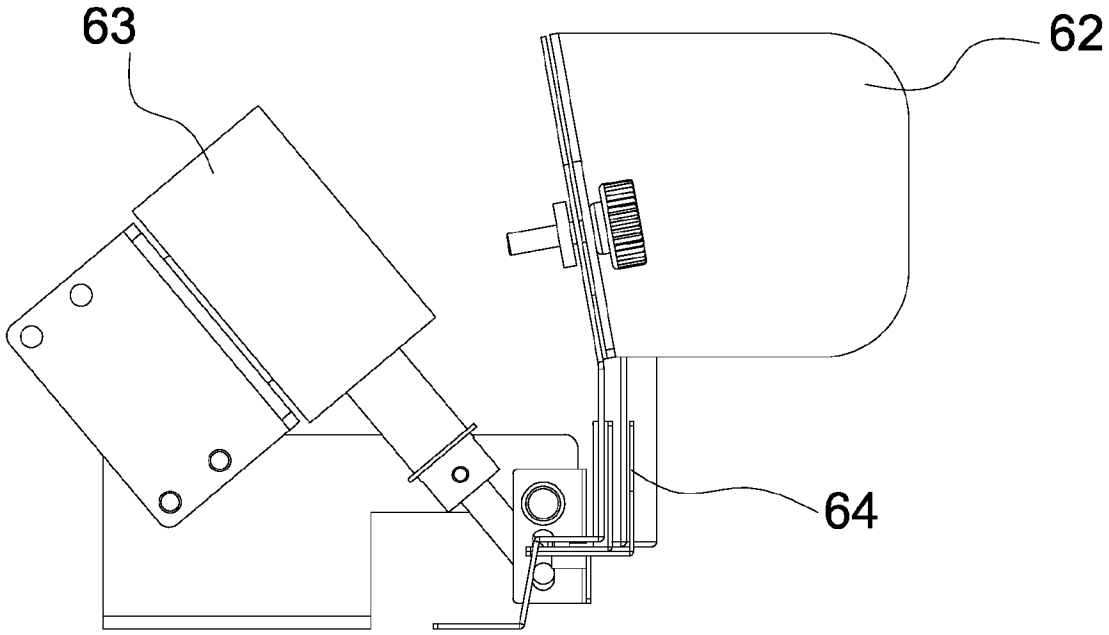
FIG. 14 is a schematic view which illustrates a pivot plate driven by a transfer motor is removed to a lower position from an upper one.
Figure 14B:
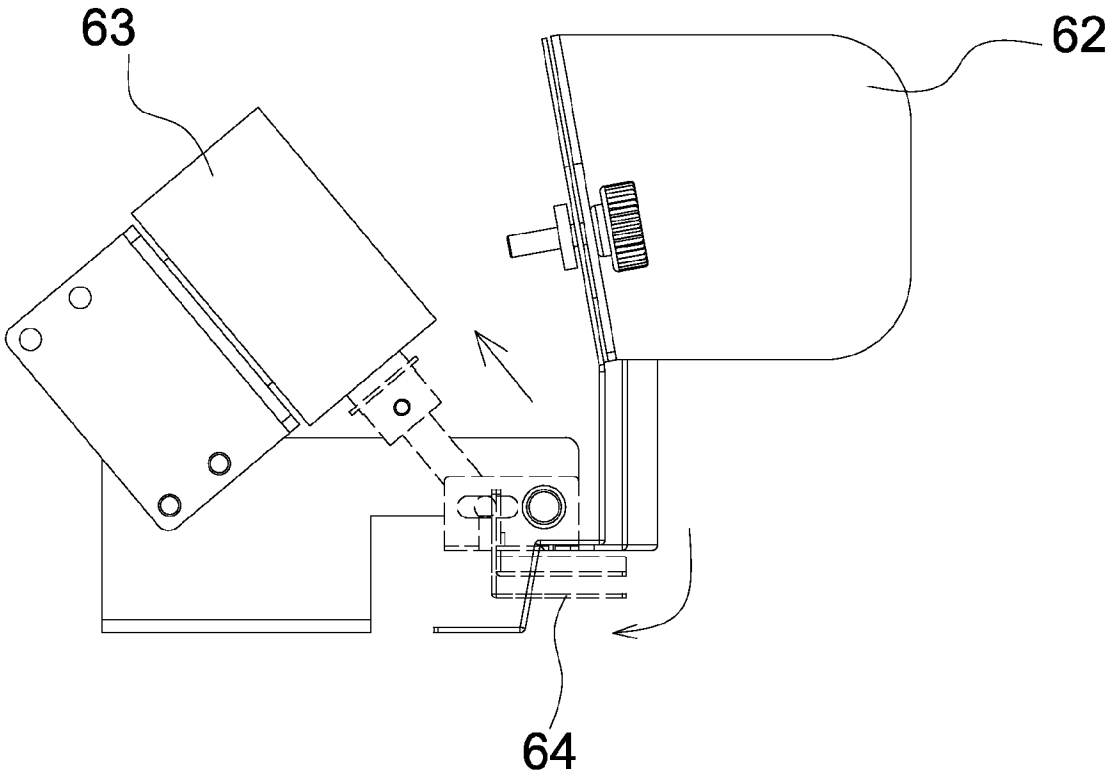
Figure 15:
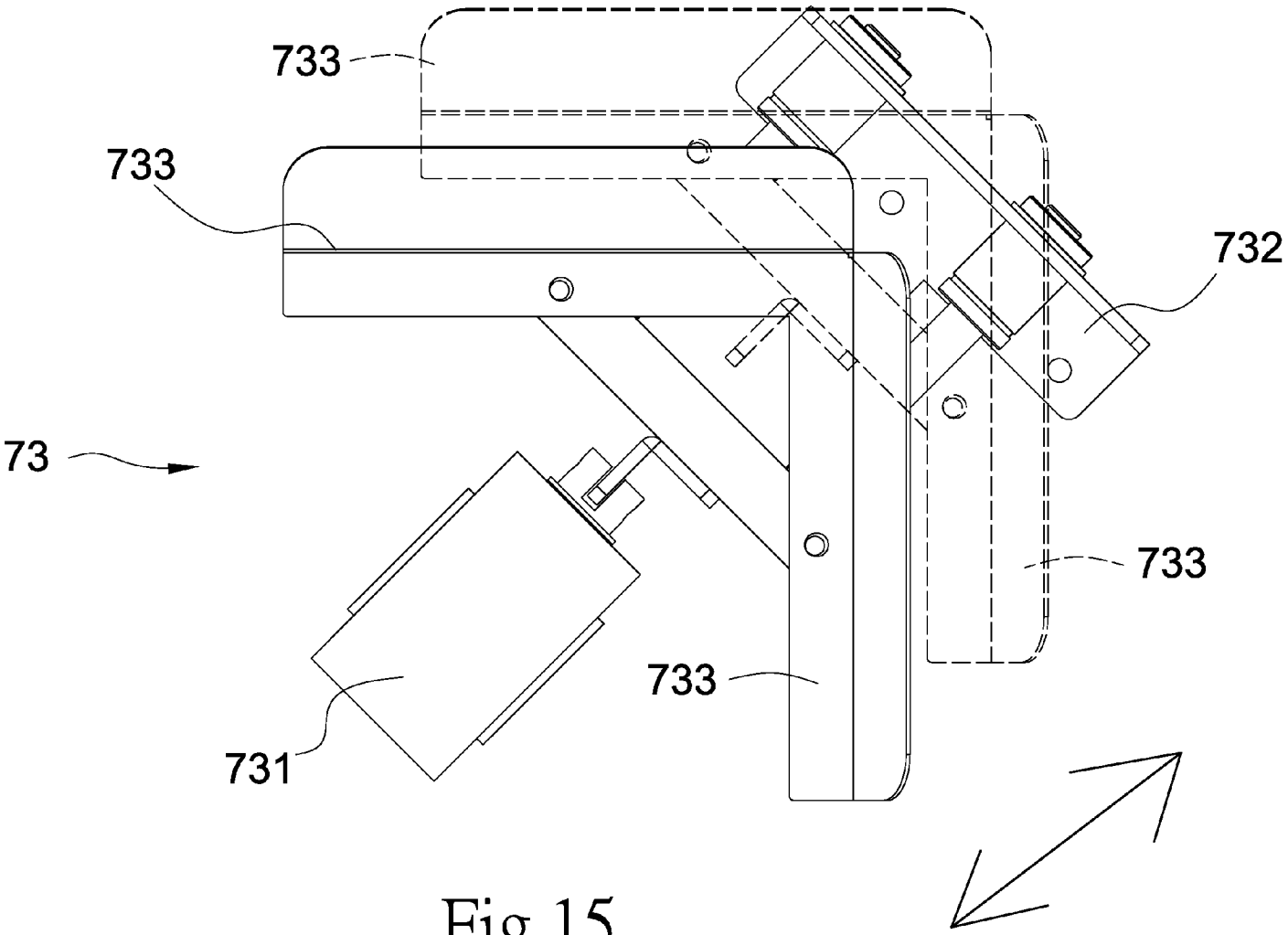
FIGS. 15 and 16 are schematic views which illustrate a push-off plate driven by a paper straightening motor is used to straighten books.
Figure 16:
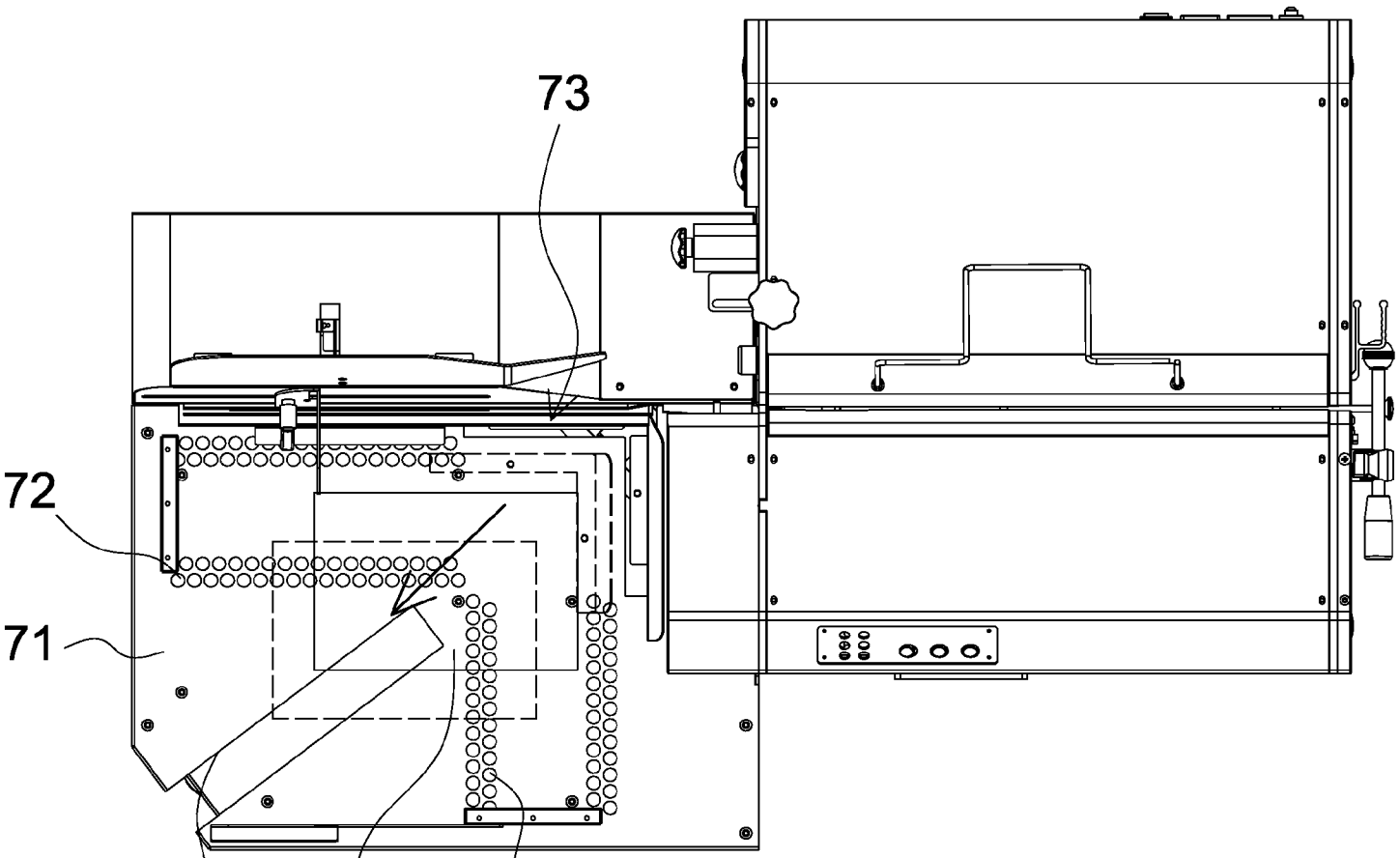

Next, the book 99 conveyed to the transfer slot 65 will be resisted by the baffle 62 and removed from an upper position to a lower one by the pivot plate 64 which is driven by the transfer motor 63 in the transfer mechanism 6 (FIG. 14), placed on the collection platform 71 of the paper straightening/collection mechanism 7, removed by the pair of push-off plates 733 which is driven by the paper straightening motor 731 of the paper straightening device 73 (FIGS. 15 and 16), resisted by the limited post 72, and collected/straightened in a punching process. As previously mentioned, a fast precise punching process is completed and operated repeatedly.

Moreover, the debris collection box 8 can be removed from the base 1 with the punching process initiated quite a while (FIG. 17) for gathering debris in the debris collection box 8. As such, the present invention contributes to not only recycling but also tidy and clean surrounding.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automated book punch, comprising:

a base with a paper tray;

a positioning mechanism completing reciprocal movement from a fixed position at which said positioning mechanism locates a book held in said paper tray to an open position at which said positioning mechanism allows said book in said paper tray to pass;

a punching mechanism which is used to punch said book in said paper tray;

a conveying mechanism which conveys said book held in said paper tray and comprises a conveying motor, a master wheel, a slave wheel and a belt, wherein said conveying motor is securely held in said base; said master wheel which links and is driven by said conveying motor turns locally; said slave wheel is properly pivoted to said base and turns locally; said belt encircling both said master wheel and said slave wheel is driven to turn by said master wheel and comprises a number of conveying columns situated on its external surface, arranged in a predetermined spacing, and used to shift and convey said book;

a transfer mechanism which is used to transfer said punched book to a predetermined position from said conveying mechanism, and comprises a backup plate, a transfer motor and a pivot plate, wherein said transfer motor is installed on said backup plate, and said pivot plate linking and driven by said transfer motor is able to complete a reciprocal movement between an upper position and a lower position; and a paper straightening/collection mechanism which is used to collect and straighten said book from said transfer mechanism.

2. The automated book punch according to claim 1 wherein said positioning mechanism comprises two slide bars, a slide carriage, a knob, a positioning motor and two locators; said slide bars are horizontally held in said base; said slide carriage is movably connected to said slide bars and linearly and reciprocally shifted along said slide bars under effect of an external force; said knob locked on said slide carriage can be screwed or unscrewed so that said slide carriage is incapable of or capable of completing relative sliding along said slide bar under effect of an external force, respectively; said positioning motor is situated on said slide carriage; said two locators which are parallel to each other and link and are driven by said positioning motor complete reciprocal movement from a fixed position at which said locators extend into said paper tray and block said book to an open position at which said locators stay beyond said paper tray and allow said book to pass.

* * * * *